US011787202B2

(12) United States Patent
Schuesslburner et al.

(10) Patent No.: US 11,787,202 B2
(45) Date of Patent: Oct. 17, 2023

(54) CONTAINER TREATMENT SYSTEM FOR TREATING CONTAINERS

(71) Applicant: DEKRON GMBH, Kelkheim (DE)

(72) Inventors: Helmut Schuesslburner, Straubing (DE); Konrad Senn, Alteglofsheim (DE); Sven Kerpe, Linkenheim-Hochstetten (DE); Frank Schulze, Schwarzenbach am Wald (DE); Thomas Gruber, Riekofen (DE); Thomas Schnitger, Eisenach (DE)

(73) Assignee: DEKRON GMBH, Kelkheim (DE)

( * ) Notice: Subject to any disclaimer, the term of this patent is extended or adjusted under 35 U.S.C. 154(b) by 0 days.

(21) Appl. No.: 17/418,755

(22) PCT Filed: Sep. 18, 2019

(86) PCT No.: PCT/EP2019/074981
§ 371 (c)(1),
(2) Date: Jun. 25, 2021

(87) PCT Pub. No.: WO2020/135937
PCT Pub. Date: Jul. 2, 2020

(65) Prior Publication Data

US 2022/0063295 A1 Mar. 3, 2022

(30) Foreign Application Priority Data

Dec. 28, 2018 (DE) ..... 10 2018 251 784.3

(51) Int. Cl.
*B41J 3/407* (2006.01)
*B41J 3/44* (2006.01)
*B67C 7/00* (2006.01)

(52) U.S. Cl.
CPC ..... *B41J 3/445* (2013.01); *B41J 3/40733* (2020.08); *B67C 7/002* (2013.01); *B41J 3/4073* (2013.01)

(58) Field of Classification Search
CPC ..... B41J 3/445; B41J 3/40733; B67C 7/002
See application file for complete search history.

(56) References Cited

FOREIGN PATENT DOCUMENTS

| | | | | |
|---|---|---|---|---|
| CN | 108292129 A | | 7/2018 | |
| DE | 3119990 | * | 12/1982 | ..... B65G 47/5113 |
| DE | 102010045661 A1 | | 3/2012 | |
| DE | 102012206295 A1 | | 10/2013 | |

(Continued)

OTHER PUBLICATIONS

ISA European Patent Office, International Search Report Issued in Application No. PCT/EP2019/074981, dated Dec. 10, 2019, WIPO, 4 pages.

(Continued)

*Primary Examiner* — Christopher E Mahoney
*Assistant Examiner* — Marissa Ferguson-Samreth
(74) *Attorney, Agent, or Firm* — McCoy Russell LLP

(57) ABSTRACT

Container treatment system for treating containers, such as bottles, with at least one direct printing machine for applying a print image onto containers and at least one container treatment machine arranged upstream of the direct printing machine and a system control device, where the system control device is configured to control the operation of the container treatment machine in dependence of a change of the container throughput that can be obtained with the direct printing machine.

13 Claims, 4 Drawing Sheets

(56) References Cited

FOREIGN PATENT DOCUMENTS

| | | | | | |
|---|---|---|---|---|---|
| DE | 102013226731 | A1 | | 6/2015 | |
| DE | 102015209367 | A1 | | 11/2016 | |
| DE | 102015114947 | A1 | | 3/2017 | |
| DE | 102016104618 | A1 | | 9/2017 | |
| EP | 1837157 | A2 | | 9/2007 | |
| JP | 102013226731 | | * | 12/2013 | ..... B41J 3/407 |
| JP | 102015209367 | | * | 5/2015 | ..... B41J 3/407 |

OTHER PUBLICATIONS

China National Intellectual Property Administration, Office Action and Search Report Issued in Application No. 201980093050.X, dated May 30, 2022, 12 pages. (Submitted with Partial Translation).

* cited by examiner

CONTAINER TREATMENT SYSTEM FOR TREATING CONTAINERS

CROSS REFERENCE TO RELATED APPLICATIONS

The present application is a U.S. National Phase of International Application No. PCT/EP2019/074981 entitled "CONTAINER TREATMENT SYSTEM FOR TREATING CONTAINERS," and filed on Sep. 18, 2019. International Application No. PCT/EP2019/074981 claims priority to German Patent Application No. 10 2018 251 784.3 filed on Dec. 28, 2018. The entire contents of each of the above-listed applications are hereby incorporated by reference for all purposes.

TECHNICAL FIELD

The present invention relates to a container treatment system for treating containers according to claim 1 and a method for controlling the operation of a container treatment machine of a container treatment system for treating containers according to claim 6.

BACKGROUND AND SUMMARY

Container treatment systems are sufficiently known from prior art. They can comprise a number of container treatment machines which enable the containers to be transported among them by way of suitable transport devices from a container treatment machine to the container treatment machine arranged downstream of this container treatment machine.

The container treatment machines allow for various treatments of containers depending on their configuration. In particular, it is now known to provide a direct printing machine that can apply a print image onto the surface of a container using digital printing techniques (for example inkjet). Further container treatment machines can be arranged upstream of these direct printing machines. It is known, for example, to clean recycled containers (for example with water) but also containers that have just been produced and to subsequently dry them. It is also known to provide a pretreatment machine upstream of the direct printing machine, such as a flame pyrolysis device, which chemically and/or physically changes the surface of the container to be printed on in the direct printing machine.

As is known, the individual container treatment machines of the container treatment system require a control device, for example, by way of control devices provided in the system control device or dedicated control devices provided in the container treatment machines.

Such options for controlling are known from DE 10 2015 114 947 A1. Default parameters are there output to at least one or more control devices of the container treatment machine and then compared with the parameters required by at least one treatment device. It is then verified whether the parameters required by the at least one container treatment device can be derived at least from the default parameters. The default parameters include, for example, the operating speed of a machine or the heating temperature of plastic preforms.

This control device basically allows for the operation of the individual container treatment machines to be coordinated with one another. However, it does not take into account that some container treatment machines are easier to adapt with regard to their operating parameters than other container treatment machines.

Object

Accordingly, it is the object of the present invention to specify a container treatment system in which the operation of all container treatment machines can be controlled reliably and the special requirements for direct printing onto containers are met at the same time.

Solution

This object is satisfied according to the invention by the container treatment system according to claim 1 and the method for controlling the operation of a container treatment machine of a container treatment system for treating containers according to claim 6. Advantageous developments of the invention are comprised in the dependent claims.

The container treatment system for treating containers, such as bottles, comprises at least one direct printing machine for applying a print image onto containers and at least one container treatment machine arranged upstream of the direct printing machine as well as a system control device, where the system control device is configured to control the operation of the container treatment machine in dependence of a change of the container throughput that can be obtained with the direct printing machine.

A number of containers that can be treated with a container treatment machine during a specific time interval is regarded to be the container throughput. With regard to the direct printing machine, this corresponds to the number of containers having a print applied per time interval. For example, such a direct printing machine can print onto 1000 containers per hour.

The system control device can be a central control device that is provided for the container treatment system as a whole and that can control each container treatment machine of the container treatment system or at least the direct printing machine and the container treatment machine to be controlled. Decentralized control devices of the individual container treatment machines can also be viewed as system controls devices. System control devices can be, for example, computers or the like.

Controlling the operation can comprise both setting operating parameters as well as controlling the operation of the container treatment machine, where a corresponding control loop is then provided to regulate the operation of the container treatment machine.

It is a finding of the present invention that it is difficult in terms of process technology to control or adjust the container throughput of a direct printing machine as desired. It is therefore a finding of the present invention that the container treatment machines arranged upstream of the direct printing machine can be more easily adapted in terms of process technology to changing operating parameters, such as the container throughput of the direct printing machine, so that a uniform good result is obtained in direct printing. In particular, it can thus be prevented that the surface properties of the containers are being negatively influenced due to disadvantageous downtimes of containers upstream of the direct printing machine and the printing result therefore deteriorates when the container throughput of the direct printing machine changes.

It can be provided that controlling the operation of the container treatment machine comprises controlling a container throughput of the container treatment machine, where controlling the container throughput of the container treatment machine optionally comprises changing the spacing between the containers, that are output by the container treatment machine, in dependence of a change in the container throughput of the direct printing machine.

Changing the spacing is commonly known as changing the "separation" of the containers. By adjusting the separation or the spacing between the containers, the container throughput, for example, of a pretreatment machine such as a flame pyrolysis device, can also be changed in a simple manner. If, for example, the spacing is doubled, then the total container throughput of the container treatment machine reduces by half despite the process duration remaining the same within the respective container treatment machine.

Furthermore, the container treatment system can comprise at least one of the following container treatment machines: a container washing machine, a container dryer, a pretreatment machine, a container cooler, a container inspection machine.

These machines are typically used in container treatment systems with direct printing machines and can be adapted to the container throughput of the direct printing machine in accordance with the method of the invention.

In one embodiment, the container treatment system comprises at least two of the container treatment machines that differ from one another and a first transport device is arranged between the container treatment machines for transporting containers from one container treatment machine downstream to a further container treatment machine, and where at least one second transport device is provided to supply t containers from the container treatment machine, that in the direction of transport of the container is the last one, to the direct printing machine.

It can be provided that it is not only possible to control the operation of the container treatment machine, but also the operation of the first and/or second transport device can be controlled in dependence of a change in the container throughput that can be obtained with the direct printing machine. In this way, the operation of the transport devices, which can also comprise, for example, a buffer region, can be adapted to a change in the container throughput of the direct printing machine.

It can be provided there that at least one of the container treatment machines and/or the first transport device and/or the second transport device comprises a buffer region for buffering containers.

Containers can be buffered in this buffer region when the container throughput of the direct printing machine is reduced in a manner controlled by the system control device. They are therefore temporarily stored there until there is a subsequent increase in the container throughput of the direct printing machine and they can be reintroduced into the container flow.

According to the method of the invention for controlling the operation of a container treatment machine of a container treatment system for treating containers, such as bottles, which comprises at least one direct printing machine and a container treatment machine arranged upstream of the direct printing machine as well as a system control device, it is provided that the system control device controls the operation of the container treatment machine in dependence of a change in the container throughput that can be obtained with the direct printing machine during operation.

With this method, the operation of the container treatment system can be carried out even with changing operating parameters, in particular of the container throughput of the direct printing machine, such that the requirements for direct printing are always complied with to the extent possible and a high quality of the container treatment system is therefore obtained.

It can further be provided that controlling the operation of the container treatment machine comprises controlling the operation of the container treatment machine controlling a container throughput of the container treatment machine [sic], where controlling the container throughput of the container treatment machine optionally comprises changing the spacing between the containers, that are output by the container treatment machine, in dependence of a change in the container throughput of the direct printing machine.

Controlling the spacing for controlling the container throughput constitutes the simplest possible way in terms of control technology of adjusting the container throughput of the container treatment machines arranged upstream of the direct printing machine.

In one embodiment, the system control device controls the container throughput of the container treatment machine such that that it is equal to the changed container throughput of the direct printing machine, with the exception of during an optional lead time.

This embodiment relates in particular to the case in which the container throughput of the direct printing machine changes according as planned, for example, for the reason that more extensive print images are to be applied onto the containers. The lead time is a period of time during which the container throughput of the direct printing machine is still unchanged, but the container throughput of the container treatment machine arranged upstream of the direct printing machine already corresponds to the new container throughput. This lead time can be understood, for example, to be the time span that elapses between the change in the container throughput of the direct printing machine becomes known and the actual occurrence of this change. However, it is preferably shorter than this period of time in order to ensure that all of the containers treated at the original container throughput in the container treatment system upstream of the direct printing machine can still be processed at the original container throughput of the direct printing machine. This ensures that no excess containers remain between the container treatment machine and the direct printing machine when the container throughput of the direct printing machine changes as planned.

It can presently be provided that the container throughput of the direct printing machine reduces to a new value and where the system control device controls the operation of the container treatment machine such that excess containers are buffered in a buffer region.

This embodiment can be preferred in particular if an unplanned change in the container throughput of the direct printing machine occurs, for example if one or more direct printing modules or individual print heads fail. Buffering the containers ensures that no container accumulation forms upstream of the direct printing machine, which could be detrimental to the container quality.

It can also be provided that the container throughput of the direct printing machine increases to a new value and the system control device increases the container throughput of the container treatment machine to a value that corresponds to the new value and supplies containers from a buffer region to the direct printing machine for an optional lead time.

This prevents the direct printing machine from running empty when the container throughput is increased, especially with a planned increase of the container throughput The quality of the direct print depends on many parameters and influences. If the direct printing machine runs empty in an unplanned manner, then this can have a negative impact on the quality of the print image, since, for example, the air circulation changes due to the reduced number of containers passing through.

It is provided in one embodiment that the system control device increases the container throughput of the container treatment machine over the container throughput of the direct printing machine during a pre-buffering time and supplies a number of excess containers to a buffer region, while the container throughput of the direct printing machine does not change.

It can thus be ensured during ongoing operation that the direct printing machine is prevented from emptying when the throughput of the direct printing machine is increased, in particular in an unplanned manner, since the containers held available in the buffer region can be used to compensate for reduced container throughput of the container treatment machines arranged upstream of the direct printing machine.

For example, if the throughput of the direct printing machine increases at a given point in time, then it cannot be prevented that the containers already arranged between the direct printing machine and the other container treatment machines still correspond to the previous lower throughput. This would inevitably lead to fewer containers reaching the direct printing machine than it can print onto per time interval and could therefore lead to a reduced quality of the print images applied. If, for compensation, the containers are introduced from the buffer region which can preferably be arranged, for example, directly upstream of the direct printing machine, then this disadvantage can be compensated for.

It is further provided in one embodiment that the container treatment system comprises at least two container treatment machines arranged upstream of the direct printing machine and where a first of the container treatment machines carries out time-critical container treatment and a second of the container treatment machines carries out non-time-critical container treatment, where the system control device controls the operation of the second container treatment machine in dependence of a change in the container throughput that can be obtained with the direct printing machine during operation and continues unchanged operation of the first container treatment machine.

Time-critical container treatment is such container treatment that requires a specific treatment time in the container treatment machine. For example, such time-critical container treatment is the pretreatment of a container with the aid of a flame pyrolysis device. It subjects the surface of the container to a flame which may contain certain chemical components that chemically and/or physically change the surface. The treatment time of the containers in this flame pyrolysis device is typically not easy to regulate; in particular, the duration of the flame pyrolysis treatment cannot be regulated up or down, since otherwise the containers could become charred.

Container treatment that is non-time-critical is container treatment in which, in particular, longer treatment of the container than usual does not have a detrimental effect on the quality of the print image. For example, it is not critical for the quality of the print image whether the containers are exposed to water for 10 minutes or 20 minutes in a washing device for the containers. The dwell time of the containers in a cooling device for the containers is also such non-time-critical container treatment. As soon as the containers have passed through a minimum dwell time in the cooling device for being cooled to the desired temperature, the containers dwelling in this cooling device for a longer time is not critical. This is where one can start and adapt the container throughput to non-time-critical container treatment machines by controlling the operating speed without influencing the quality of the print images applied onto the containers, while the operation of the time-critical container treatment machines continues unchanged [sic]. The unchanged continuation, however, can also comprise that the spacing of the containers supplied by the time-critical container treatment machines is increased so that the container throughput of this machine does change although the dwell time of the containers therein remains constant.

It can additionally be provided that the first container treatment machine is arranged upstream of the second container treatment machine and where the container throughput of the direct printing machine reduces and the system control device controls the operation of the second container treatment machine such that a number of containers supplied to the direct printing machine by the second container treatment machine corresponds to the reduced container throughput and an excess of containers from the first container treatment machine is buffered in the second container treatment machine and/or a buffer region associated with the second container treatment machine.

The second container treatment machine there simultaneously acts as a buffer region. In this way, an accumulation of the containers can be staved off, in particular when the container throughput of the direct printing machine reduces.

It can be provided in a further embodiment that the second container treatment machine is arranged upstream of the first container treatment machine and where the container throughput of the direct printing machine reduces and the system control device controls the operation of the second container treatment machine such that a number of containers supplied to the first container treatment machine corresponds to the reduced container throughput.

This can be implemented, for example, by increasing the spacing between the containers that are supplied to the first container treatment machine. Since the treatment duration in the time-critical container treatment machine (first container treatment machine) cannot easily be changed, it is nevertheless ensured in this manner that these containers are only treated at the reduced container throughput corresponding to the direct printing machine.

DETAILED DESCRIPTION

Figure 1:
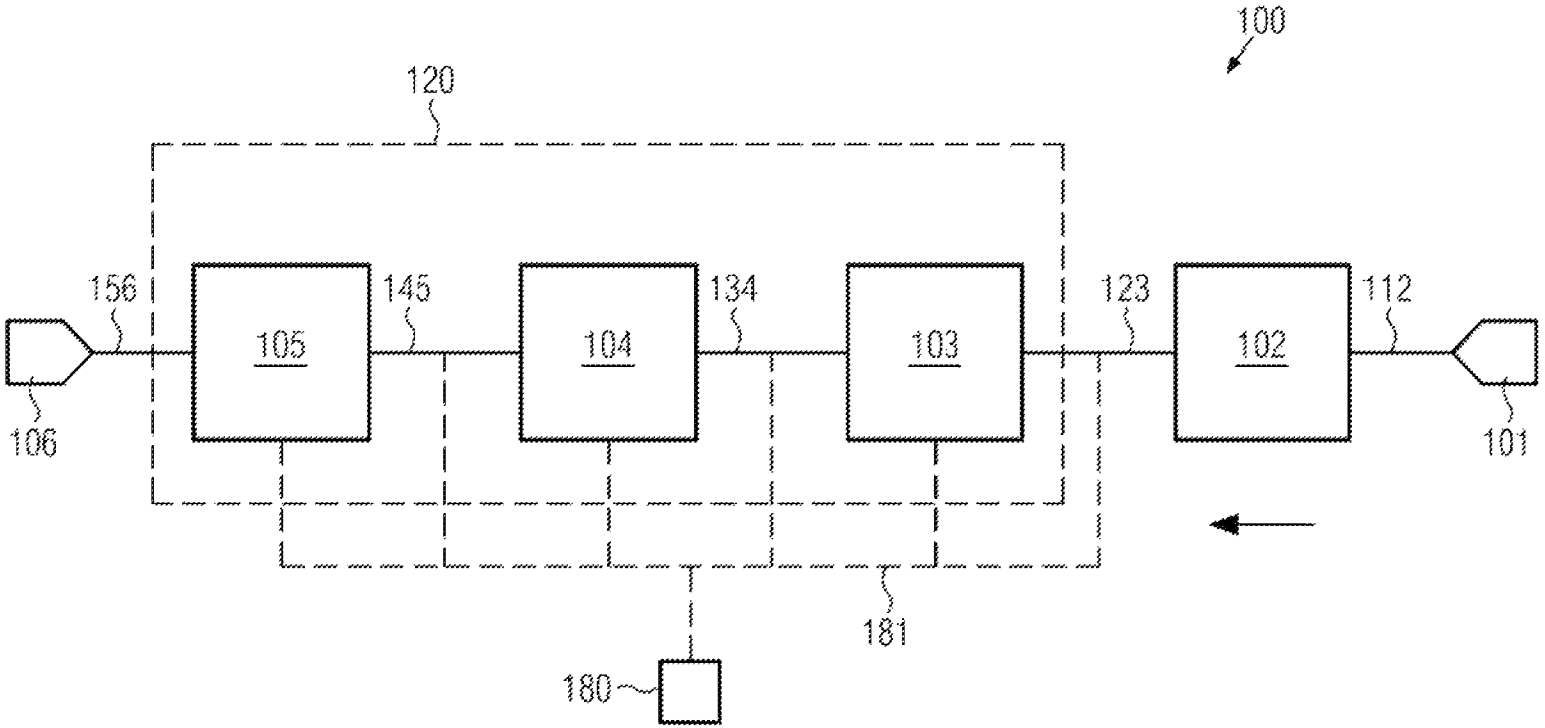
FIG. 1 shows a schematic arrangement of container treatment machines in a container treatment system according to the invention

FIG. 1 shows a container treatment system according to one embodiment of the invention. The container treatment system presently shown comprises a point of supply 101 of containers and a point of reception 106 of containers. The containers are moved from point of supply 101 via a series of machines 102 to 105 to point of reception 106. The point of supply can be, for example, a blow-molding machine or the like. The point of reception can be, for example, a packer or a palletizer.

Several container treatment machines 102 to 105 are disposed between the point of supply and the point of reception. They are not limited in number. In particular, there can be more or fewer container treatment machines than illustrated. Furthermore, for example, a further container treatment machine can be arranged between point of supply 101 and container treatment machine 102. An additional container treatment machine can also be arranged downstream of container treatment machine 105, but upstream of point of reception 106.

According to the invention, it is only provided that at least container treatment machine 105 is a direct printing machine which can print onto containers such as bottles or the like using direct printing technology (for example, inkjet printing). At least one further container treatment machines can be arranged according to the invention upstream of direct printing machine 105. They are not restricted in terms of their function. For example, machines can be provided for pre-treating the containers, for inspecting the containers, or for cleaning and drying or cooling the containers. Container treatment machines 103 and 104 (and possibly further container treatment machines) can therefore be, for example, container washing machines, container dryers, pretreatment machines, container coolers, or container inspection machines.

Further container treatment machines, such as container treatment machine 102 as well as point of supply 101 and point of reception 106 of containers, are not to be understood according to the invention to be restrictive and are therefore only used in FIG. 1 for a better understanding of the arrangement of the container treatment machines that is essential to the invention.

According to the invention, a system control device 180 is provided which can control the operation of direct printing machine 105 and at least one of container treatment machines 103 and 104 arranged in region 120 outlined by dashed lines. System control device 180 can of course also be configured to control container treatment machine 102. The system control device can be configured in principle to control each container treatment machine, including point of supply 101 and point of reception 106, as well as each transport device in the system. While selectively controlling container treatment machines 103 and 104 shall be discussed hereafter, it is implicitly understood that the other container treatment machines, in particular container treatment machine 102, can also be controlled by the system control device.

Region 120 differs from other regions in the container treatment system in that certain requirements for the transportation and treatment of the containers must be fulfilled in this region in order to be able to ensure the requirements for the direct print for containers. For example, the containers contacting one another before they are supplied to the direct printing machine is typically disadvantageous since this can cause, for example, abrasions on the surface. As a result, not only can the surface of the container itself be damaged, but also, for example, a primer layer applied in one of container treatment machines 103 or 104 (applied, for example, by way of flame pyrolysis or plasma) can be removed. Such layers are typically applied to improve the adhesion properties of printing ink to the surface of the container. If this layer is removed at least in part by physical contact among the containers, then the quality of the print images, which are thereafter applied to a damaged region, reduces.

Machine 102 can in principle be of any desired type. However, it is a separation device which controls the number of containers that are fed to machine 103.

In addition to the container treatment machines, a number of transport devices 112, 123, 134, 145 and 156 are also shown in FIG. 1. They serve to transport the containers between the container treatment machines arranged along the direction of transport of the containers and can be configured in any conventional manner. For example, they can be bulk conveyors. Alternatively or additionally, transport devices which enable the containers to be transported individually, for example, by neck handling, can also be provided. The configurations of the container transportation are presently not restrictive and are implemented by the person skilled in the art as appropriate.

System control device 180 can either be configured as a central control device (in the form of a computer or data processor or the like) and can be connected to direct printing machine 105 and at least one further container treatment machine 104 or 103 via connections 181 presently shown only by way of example for preferably bidirectional data exchange. In addition, the system control device can also be connected to the individual transport devices between the container treatment machines at least in region 120.

However, the system control device can also be configured differently. For example, in addition to or as an alternative to the central control unit, a series of control units provided specifically for a container treatment machine or a container treatment machine and the transport devices associated therewith and/or a transport device can be provided. There as well, this can be suitable computers or data processors which, however, then control only specific container treatment machines and/or transport devices. In this embodiment, the control devices are preferably interconnected at least for the purpose of data exchange. This can also be done by suitable (bidirectional) data lines, in analogy to data lines 180. The data lines can be configured physically (as a LAN cable or the like) or wirelessly (for example as a wireless LAN network).

The containers typically do not touch each other when transported through the container treatment system during "normal" operation. In more general terms, once the operating parameters have been set and there are no malfunctions, then the requirements of direct printing onto the containers in the direct printing machine can typically be met without changes to the operation of the transport devices and/or container treatment machine arranged upstream of the machine becoming necessary.

However, if a change in the operating parameters of the direct printing machine occurs, in particular a reduction in the container throughput of the direct printing machine, then this can inadvertently lead to an accumulation of containers due to the high transport speeds of the containers in conventional container treatment systems (several 1000 containers per hour), which may result in damage to the containers or other negative influences, such as an excessively long dwell time of the containers between two successive treatment steps (which typically have to be carried out in a narrowly limited time window).

According to the invention, system control device 180 is therefore configured such that it can control the operation of at least container treatment machines 103 and 104 and possibly transport devices 134 and 135 upstream of direct printing machine 105 in region 120 in dependence of the container throughput of the direct printing machine. This means in particular that, if the container throughput of the direct printing machine is reduced (planned or unplanned), then the container throughput of the container treatment machines arranged upstream of the direct printing machine is also reduced. The container throughput is basically understood to mean the number of containers treated in the individual container treatment machines per time interval (typically the number of containers per hour). The container throughput of a given container treatment machine can be reduced in a number of ways.

If it is essential for the treatment of the container how long it remains in the respective container treatment machine (time-critical treatment), then the container throughput of such a container treatment machine can be reduced by introducing containers with a larger spacing from one another into the respective container treatment machine. As a result, fewer containers in total are treated in the container treatment machine during the same time interval, while the dwell time of the containers in the container treatment machine and therefore also the treatment time can remain the same. At the same time, the container throughput of such a container treatment machine can also be increased by supplying containers with a smaller spacing. Such container treatment machines, in which the dwell time of the containers in the container treatment machine or the treatment time of the containers in the relevant container treatment machine must remain constant, are called time-critical container treatment machines or time-critical container treatment.

Other container treatment machines, in which the dwell time of the containers and/or the treatment time of the containers is not relevant for the outcome of the treatment, are referred to as non-time-critical container treatment machines or non-time-critical container treatment. This includes, for example, cooling the containers in a cooling machine or a cooling tunnel. The container treatment is there uncritical at least in that a longer dwell time than the minimum cooling period is harmless, since the container then only remains at a constant temperature. In such a case, the transport speed of the containers through the respective non-time-critical container treatment machine can be increased or decreased, depending on whether the container throughput of the direct printing machine increases or decreases. The container throughput can then be controlled by adjusting the transport speed.

Alternatively or additionally, buffer regions can also be provided either in the individual container treatment machines and/or in the transport devices at 123, 134 and 145, in which containers can be buffered (preferably without touching each other or experiencing other adverse influences).

Figure 2:
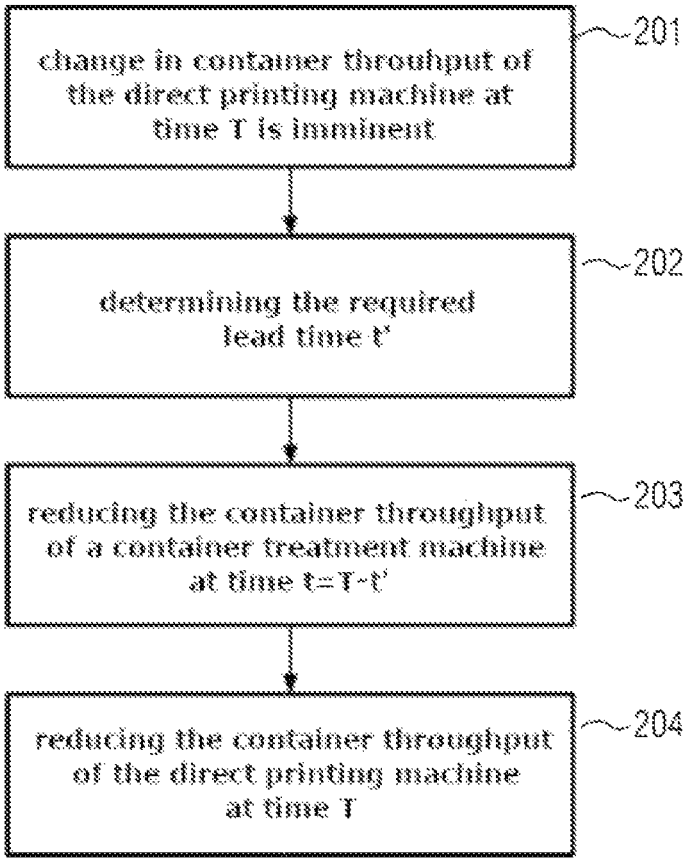
FIG. 2 shows a flow diagram of an embodiment in which the change in the container throughput of the direct printing machine occurs as planned FIGS. 3*a*+*b* show a flow diagram of two embodiments in which the change in the container throughput of the direct printing machine occurs in a manner that is not planned

FIG. 2 shows a flow chart illustrating the method for controlling the operation of the container treatment machines of the container treatment system in one embodiment for a planned change in the container throughput of the direct printing machine. The steps described below can also be supplemented by further steps and are therefore not to be understood to be restrictive.

A "planned" change in the container throughput of the direct printing machine is such a change (increase or decrease in the container throughput), the occurrence of which at a point in time t is known at an earlier point in time. This can be, for example, a changeover from a first type of print image to a second type of print image. The first type of print image can have a given printing time that differs from the second type of print image. This difference in the printing times also changes the container throughput that can be obtained with the direct printing machine. For example, if the printing time required per container increases with this planned change, then the container throughput reduces accordingly.

According to FIG. 2, system control device 180 (see FIG. 1) first establishes that a change in the container throughput is imminent at a time T which is still in the future. In the embodiment described in FIG. 2, it is assumed that the change is a reduction in the container throughput of the direct printing machine. However, it is understood that this can also be the case for an increase.

After the imminent change has been established in step 201, the system control device first determines a required lead time t' in a step 202. The required lead time t' is ultimately a time that is required in order to process the containers in the direct printing machine that are still processed in the container treatment machines according to the old throughput (before the imminent change). Lead time t' results from the number of containers still present between the last container treatment machine arranged upstream of the direct printing machine and the direct printing machine and the container throughput of the direct printing machine prior to the change at time T. The number of these containers typically results from the capacity (e.g. of transport device 145) and is a known variable. This variable can be referred to as M. If the original throughput is designated as D, then the lead time t' required in each case results from t'=M/D. Once this lead time has been determined, system control device 180 can use this to calculate the point in time t at which at least the container throughput of the container treatment machine arranged directly upstream of the direct printing machine must be reduced. This point in time results from t=T−t'.

It is understood that this time can be calculated in a corresponding manner for container treatment machines arranged further upstream. In this case, the number of containers remaining between the respective container treatment machine and the direct printing machine is typically determined by the aforementioned variable M and the number $M_2$ of further containers disposed between the first container treatment machine arranged upstream of the direct printing machine and the respective container treatment machine. The required lead time $t_2$ there results from $(M+M_2)/D$, since the container throughput of all container treatment machines with the previous operation (prior to the change at time T) is equal to the throughput of the direct printing machine.

The lead times for all container treatment machines upstream of the direct printing machine can be determined in this manner, which must be adhered to in order to change the throughput throughout and without accumulation of containers. This results from $$t_i = \frac{\sum_i M_i}{D},$$

where i indicates the container treatment machine for which the respective lead time is to be calculated. It is counted starting with the first container treatment machine i=1 arranged upstream of the direct printing machine and is increased by 1 with each container treatment machine arranged upstream.

In the next step 203, the system control then controls the throughput of the respective container treatment machine at a suitable time t=T−t' (corresponding to $T-t_i$ for each of the container treatment machines) For the case presently described in which the throughput of the direct printing machine reduces, this means quasi a reduction in the throughput of the respective container treatment machine from the original throughput D to the new throughput D'.

The system control device subsequently controls the throughput of the direct printing machine when time T occurs (reduces it to the desired value), so that the throughput of the direct printing machine is reduced accordingly simultaneously with the arrival of the first container to be treated according to the new at the direct printing machine.

Buffer regions can be omitted with these configurations.

If the change in the container throughput of the direct printing machine is an increase in the container throughput, then it must also be ensured that the container treatment machines arranged upstream of the direct printing machine produce an increased container throughput at the same times. The control method by the system control device, as described in FIG. 2, does not change as a result. The control method by the system control device, as described in FIG. 2, does not change as a result. However, in order to prevent an accumulation of containers produced according to the new throughput while the direct printing machine is still processing containers according to the old throughput, a buffer region can be provided at least in transport device 145 arranged immediately upstream of the direct printing machine and in which the containers manufactured or treated already according to the new throughput in the upstream container treatment machine can be temporarily stored without the containers being damaged or the containers touching one another, in order to still be able to meet the requirements for direct printing.

FIG. 3 shows embodiments of unplanned changes in the container throughput of the direct printing machine. A distinction must there be made between time-critical and non-time-critical processes (as already stated above).

Figure 3A:
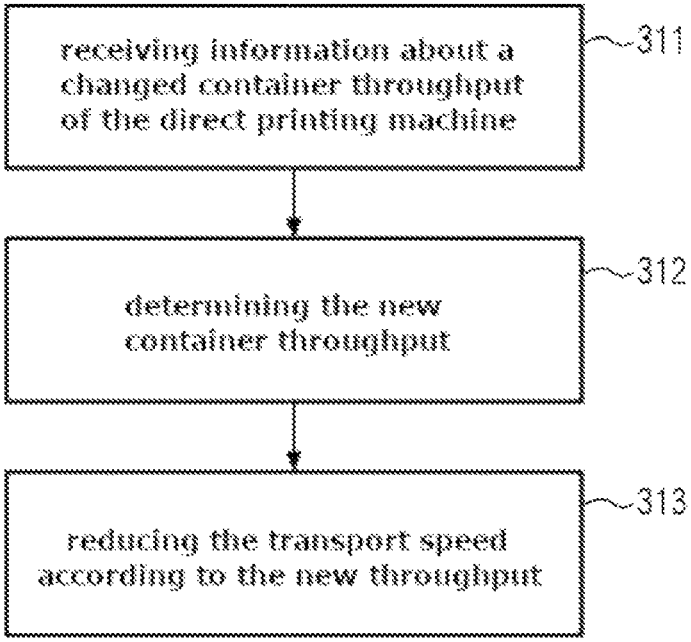
Figure 3B:
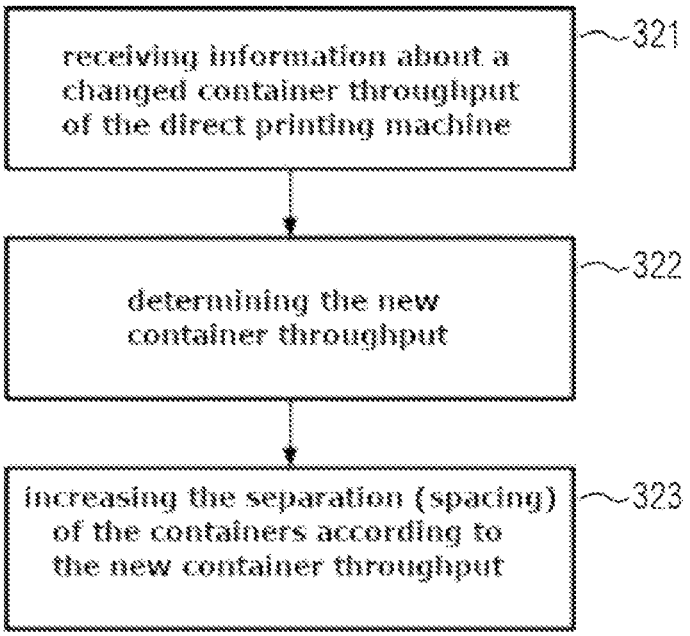

FIG. 3*a* describes the adjustment of the operation of a container treatment machine with non-time-critical container treatment, whereas FIG. 3*b* describes the change in the operation of a container treatment machine which carries out time-critical container treatment.

In first step 311 according to FIG. 3*a*, the system control device receives information from the direct printing machines that a non-planned change in the container throughput occurs. For example, the system control device can receive information from the direct printing machine in step 311 that one of the printing modules has failed.

The system control device can use this to determine in step 312 how the throughput of the direct printing machine has now changed. If a printing module fails, it will usually decrease, for example, to a value which corresponds to the quotient of the number of printing modules still available and the total number of printing modules.

On the basis of this information, the system control device now knows the new container throughput at which the non-time-critical container treatment machine must output containers. It then controls the non-time-critical container treatment machine in step 313 in such a way that its container throughput (in this case the output of the containers in the direction of the direct printing machine) is reduced to the new throughput of the direct printing machine. This can be achieved, for example, by reducing the transport speed of the containers in the non-time-critical container treatment machine. Since an increased dwell time in the non-time-critical container treatment machine is not critical for the quality of the print images to be applied to the containers, this does not result in any disadvantage for the subsequent printing.

This can be explained using the example of a cooling tunnel which is typically arranged upstream of any possible pre-treatment machines.

Containers are fed to the cooling tunnel by way of a separation (for example container treatment machine 102 shown schematically in FIG. 1). If the throughput of containers of the direct printing machine now reduces, then the separation can be controlled by system control device 180 such that that it continues to transfer groups of containers to the cooling tunnel, where the number and dimensions (for example, width of the group of containers and length of the group of containers) corresponds to the original throughput. However, the separation can be controlled in such a way that it stops the supply of containers after the respective transfer of such a group (also referred to as a batch) of containers to the cooling tunnel. The duration of this stop can be geared toward the new container throughput of the direct printing machine, so that the total number of containers supplied to the cooling tunnel per unit time is reduced in accordance with the new throughput of the direct printing machine.

In the cooling tunnel itself, the transport speed of the containers can then be reduced such that the spacing between the containers within the cooling tunnel remains constant (i.e. corresponds exactly to the spacing that was also provided for the original container throughput of the direct printing machine was) despite the supply of groups of containers being stopped due to the separation. This reduces the number of containers that leave the cooling tunnel at the end per unit time and therefore the container throughput, while their spacing from one another and therefore also the cooling outcome remains constant. This then corresponds to step 313 in FIG. 3*a*.

This configuration also provides the advantage that the speed of the conveyor belt or, more generally, of the transportation through the cooling tunnel can be increased immediately when the container throughput of the direct printing machine is increased again, but the spacing between the containers still corresponds to that of the original container throughput, which ensures the further treatment of the containers and in particular printing onto the containers in the direct printing machine also according to the original throughput without gaps in the container flow arising.

FIG. 3*b* shows an embodiment of the change in the container throughput for a time-critical container treatment machine. Such a time-critical container treatment machine is, for example, a pretreatment machine such as a flame pyrolysis device, since the treatment time there and therefore also the dwell time of the containers in the corresponding machine cannot be varied without having a negative impact on the printing result.

FIG. 3*b* steps 321 and 322 in analogy to FIG. 3*a*. Here as well, the corresponding new container throughput of the direct printing machine is determined in step 322 after receipt (311) of the information at the system control device that the container throughput of the direct printing machine is changing (for example with the information that a printing module has failed).

Since the dwell time of the containers in the time-critical container treatment machine cannot be increased, the system control device, however, controls the time-critical container treatment machine in step 323 such that the spacing between the containers in the container treatment machine is increased, namely according to the reduction in throughput. It then is true that the new spacing l' of the containers results from the original spacing l at the original throughput D from $l'=l*D/D'$, where D' is the now reduced throughput.

It is understood that the increase in the spacing entails that the number of containers which is supplied to the time-critical container treatment machine per unit time must also decrease. Otherwise, container accumulation occurs upstream. This can be achieved, for example, in that the throughput of a non-time-critical container treatment machine arranged upstream of the time-critical container treatment machine is reduced accordingly (as was described in FIG. 3*a*).

Alternatively or additionally, it can also be provided that buffer regions associated with individual container treatment machines or transport devices are filled with containers.

It can also be ensured by using buffer regions that the required increased throughput of containers can be quickly restored without the direct printing machine running idle when the container throughput is subsequently increased in the direct printing machine (for example after replacing or repairing the damaged printing module). Where the excess of containers per unit time possibly arising as long as the throughput of the entire container treatment system has not yet been reduced to the new throughput of the direct printing machine results from $H=D-D'$. If time t that is necessary to reduce the total throughput of the container treatment system according to the above embodiments is known, then the required buffer capacity for containers in the buffer regions can be determined from this time t by way of $H*t=P$ (P corresponds to the total number of bufferable containers). Alternatively or additionally, however, this capacity P can also be determined such that it is sufficient for a predicted downtime t.

During the construction and planning of the container treatment system, it is possible, for example, to test or simulate how long the maximum downtimes are in the event of certain malfunctions. This gives rise to a number of downtimes, the largest of which can be selected as the basis for determining the buffer capacity, so that all possible downtimes (for example, of one or more printing modules) can be absorbed in all events by these buffer regions.

While not explicitly stated above, it is nevertheless provided according to the invention that the methods described can be applied to every conceivable transportation and every conceivable combination of containers. In particular, the methods described, for example, the embodiments described in FIGS. 3*a* and 3*b*, can be applied to methods in which containers are transported in fixed groups with a fixed arrangement of the containers in each group (including "batch-wise" transportation of containers) or in which the containers are transported in groups or in a container flow in which the spacing between the containers themselves is variable. These variants of transportation are in fact possible for both time-critical and non-time-critical treatments of containers, as described above.

The invention claimed is:

1. A container treatment system for treating containers, with at least one direct printing machine for applying a print image onto containers and at least one container treatment machine, arranged upstream of said direct printing machine as well as a system control device, where said system control device is configured to control an operation of said container treatment machine in dependence of a change in the container throughput that can be obtained with said direct printing machine, where controlling the operation of said container treatment machine comprises controlling a container throughput of said container treatment machine, where said system control device controls the container throughput of said container treatment machine such that that it is equal to the changed container throughput of said direct printing machine, with the exception of during an optional lead time.

2. The container treatment system according to claim 1, where controlling the container throughput of said container treatment machine by said system control device comprises changing the spacing between the containers, that are output by said container treatment machine, in dependence of a change in the container throughput of said direct printing machine.

3. The container treatment system according to claim 1, where said container treatment system comprises at least one of the following container treatment machines: a container washing machine, a container dryer, a pretreatment machine, a container cooler, a container inspection machine.

4. The container treatment system according to claim 3, where said container treatment system comprises at least two of said container treatment machines that differ from one another and where a first transport device is arranged between said container treatment machines for transporting containers from one container treatment machine downstream to a further container treatment machine, and where at least one second transport device is provided which can supply said containers from said container treatment machine, that in a direction of transport of said containers is the last one, to said direct printing machine.

5. The container treatment system according to claim 4, where at least one of said container treatment machines and/or said first transport device and/or the second transport device comprises a buffer region for buffering containers.

6. A method for controlling an operation of a container treatment machine of a container treatment system for treating containers, which comprises at least one direct printing machine and the container treatment machine arranged upstream of said direct printing machine as well as a system control device, where said system control device controls the operation of said container treatment machine in dependence of a change in the container throughput that can be obtained with said direct printing machine during operation, where controlling the operation of said container treatment machine comprises controlling a container throughput of said container treatment machine, where said system control device controls the container throughput of said container treatment machine such that that it is equal to the changed container throughput of said direct printing machine, with the exception of during an optional lead time.

7. The method according to claim 6, where controlling the operation of said container treatment machine by said system control device comprises changing the spacing of the containers, that are output by said container treatment machine, in dependence of a change in the container throughput of said direct printing machine.

8. The method according to claim 6, where the container throughput of said direct printing machine reduces to a new value and where said system control device controls the operation of said container treatment machine such that excess containers are buffered in a buffer region.

9. The method according to claim 6, where the container throughput of said direct printing machine increases to a new value and where said system control device increases the container throughput of said container treatment machine to a value that corresponds to the new value and supplies containers from a buffer region to said direct printing machine for an optional lead time.

10. The method according to claim 6, where said system control device increases the container throughput of said container treatment machine via the container throughput of said direct printing machine during a pre-buffering time and supplies a number of excess containers to a buffer region, while the container throughput of said direct printing machine does not change.

11. The method according to claim 6, where said container treatment system comprises at least two container treatment machines arranged upstream of said direct printing machine and where a first of said container treatment machines carries out time-critical container treatment and a second of the container treatment machines carries out non-time-critical container treatment, where said system control device controls the operation of said second container treatment machine in dependence of a change in the container throughput that can be obtained with said direct printing machine during operation and continues unchanged operation of said first container treatment machine.

12. The method according to claim 11, where said first container treatment machine is arranged upstream of said second container treatment machine and where the container throughput of said direct printing machine reduces and said system control device controls the operation of said second container treatment machine such that a number of containers supplied to said direct printing machine by said second container treatment machine corresponds to the reduced container throughput and an excess of containers from said first container treatment machine is buffered in said second container treatment machine and/or a buffer region associated with said second container treatment machine.

13. The method according to claim 11, where said second container treatment machine is arranged upstream of said first container treatment machine and where the container throughput of said direct printing machine reduces and said system control device controls the operation of said second container treatment machine such that a number of containers supplied to said first container treatment machine corresponds to the reduced container throughput.

* * * * *